United States Patent [19]

Adams

[11] 4,146,009

[45] Mar. 27, 1979

[54] MISSILE PROJECTING AID ATTACHMENT FOR ARCHER'S BOW

[76] Inventor: Billy D. Adams, 1004 Rosalie Ave., Opp, Ala. 36467

[21] Appl. No.: 832,629

[22] Filed: Sep. 12, 1977

[51] Int. Cl.[2] ..... F41B 5/00

[52] U.S. Cl. ..... 124/88; 124/41 R; 124/90; 124/24 R

[58] Field of Search ..... 124/41 A, 41 R, 24 A, 124/90, 88, 25, 35 A, 26, 86; 273/170

[56] References Cited

U.S. PATENT DOCUMENTS

| | | | |
|---|---|---|---|
| 300,415 | 6/1884 | Van Allen | 124/20 R |
| 1,852,401 | 4/1932 | DeCamps | 124/41 B |
| 2,221,506 | 11/1940 | Brandon | 124/21 UX |
| 2,313,803 | 3/1943 | Carlson | 124/25 |
| 3,108,583 | 10/1963 | Andis | 124/20 R X |
| 3,434,722 | 3/1969 | Esposito | 273/170 X |

*Primary Examiner*—Richard C. Pinkham
*Assistant Examiner*—William R. Browne
*Attorney, Agent, or Firm*—Smyth, Pavitt, Siegemund, Jones & Martella

[57] ABSTRACT

The attachment includes a tubular barrel through which a ball or other missile is projected by the force of the bowstring. The tubular barrel is rigidly attached at its muzzle end to the central portion of a bow, and is provided with elongated slots along its upper and lower surfaces through which the bowstring passes. Within the barrel a slidable carrier is attached to the bowstring. The carrier releasably holds the missile even when the barrel is tilted downward as well as when the bow is drawn. When the bowstring is released, the carrier and missile are driven toward the muzzle of the barrel; but, when the bowstring and attached carrier decelerate as they approach the muzzle, the momentum of the missile causes it to pull free of the carrier and to continue through the muzzle toward the target, while the carrier remains behind in the barrel. The attachment is removable from the bow and adjustable with respect to it.

7 Claims, 7 Drawing Figures

MISSILE PROJECTING AID ATTACHMENT FOR ARCHER'S BOW

BACKGROUND OF THE INVENTION

1. Field of the Invention

The present invention is in the field of mechanical projectors or archery equipment, and more specifically relates to a removable attachment for an archer's bow which permits the bow to be used for projecting balls, darts, or other missiles.

2. Description of the Prior Art

In U.S. Pat. No. 28,698, issued June 12, 1860 to Stevens, there is disclosed a cross-barrel in which a number of balls may be loaded from the breech end of the device and which are held in a firing position at the muzzle end of the device by spring clips. A rod, slidable in the barrel of the device, is attached at its rear end to the bowstring. When the bowstring is released, the rod attached to it bolts forward, and the front end of the rod strikes the ball held at the muzzle of the device knocking it forward toward the target. One can readily appreciate the tremendous impact which occurs when the rapidly moving rod strikes the stationary ball. The velocity difference is equal within a factor of 2 to the velocity with which the ball strikes the target. Such a high velocity impact could damage the ball, the rod, or both. To insure a large transfer of momentum to the ball, it is desirable that the rod be more massive than the ball. However, the more massive rod, which is attached to the bowstring, will tend to wrench the cross-bow from the user when the rod decelerates as it approaches its forwardmost position.

In U.S. Pat. No. 1,210,332, issued Dec. 26, 1916 to Kvistad, there is disclosed a mechanical leverage means for bending the bow, which has a guideway for directing dart-like arrows. The barrel is not tubular and it is not rigidly attached to the bow. In the Kvistad invention, the bowstring bears directly on the missile. This is a satisfactory arrangement where the rear end of the missile is flat and where the width of the rear end of the missle exceeds the possible lateral movement of the string. However, the Kvistad device is not suitable for projecting balls because the bowstring would tend to slide to one side or the other of the convex surface of the ball, thereby exerting an unpredictable lateral force on the ball which would seriously impair the accuracy of the device.

In U.S. Pat. No. 2,214,224, issued Sept. 10, 1940 to Douglas, there is disclosed a missile projecting device including a tubular structure. The device projects spherical missiles. The Douglas invention is really an air rifle in which the drawn bowstring, when released, drives a piston forward in a cylinder compressing the air therein. Some of the compressed air passes at a high velocity and pressure through an aperture, projecting the missile from the barrel. Immediately following the projection of the missile, and before the end of the stroke of the piston, a spike-shaped member enters the aperture blocking further passage of air therethrough and thus building up a back pressure to cushion the impact of the piston at the end of its stroke. As will be seen below, the Douglas invention is based on an entirely different principle from that of the present invention.

The present invention overcomes the impact which occurs in the Stevens cross-bow described above and the inability of the Kvistad device to project spherical missiles, also described above.

SUMMARY OF THE INVENTION

The present invention is a removable attachment which can be affixed to an archer's bow for use in projecting missiles of various shapes with considerable force and accuracy.

In the present invention, the muzzle end of a tubular barrel is rigidly, but removably, affixed to the central portion of the bow, in the general region over which an arrow would normally be held. Elongated slots extend through the top and bottom surfaces of the barrel along a substantial portion of its length. The bowstring passes vertically through these slots, which are of sufficient length to accomodate the normal movement of the bowstring.

Within the tubular barrel a hollow cylindrical carrier is provided. The carrier, in a preferred embodiment, is attached to that portion of the bowstring which extends transversely through the barrel, and the carrier is slightly smaller than the bore of the barrel so that the carrier is freely slidable within the barrel along a substantial portion of its length. The mass of the carrier is relatively small, and it is composed of a material which slides with relatively low friction against the inside of the barrel.

The purpose of the carrier is to retain the projectile so that it does not roll or slide toward the muzzle of the barrel when the barrel is pointed downward. The carrier also yieldably holds onto the missile while the bow is being drawn; the bowstring, carrier and missle being pulled together rearwardly away from the muzzle. When the bowstring is released, the attached carrier and the missle are accelerated forward toward the muzzle, and the missle rapidly gains speed. The bowstring and the attached carrier begin to decelerate after they have passed through their equilibrium position, but the momentum of the missile urges it forward, pulling it free from the carrier and permitting it to proceed through the muzzle and away toward the target.

In the preferred embodiment, the carrier is attached to the bowstring and remains in the barrel after the missile has been projected.

In the preferred embodiment, the missile is yieldably held by the carrier through friction imparted by a resilient layer of felt or similar material which is wedged between the missile and the carrier. In an alternative embodiment, the missile (or missiles, i.e., lead shot, etc.) is inserted into the cup-shaped carrier and a tight fitting plug of a resilient material such as foamed plastic is pressed into the open front end of the carrier in the manner that a stopper is inserted into a bottle.

Thus, the missile is fitted to the carrier and held to it by frictional forces which are sufficiently large to prevent the missile from being dislodged from the carrier when the barrel is pointed downward, but the frictional force is small enough to be easily overcome by the momentum of the missile when the carrier is decelerating near the end of its forward stroke.

In the preferred embodiment of the invention, the bore of the barrel has a circular cross-section, and the diameter of the missile is less than the inside diameter of the hollow cylinderical carrier. That diameter, in turn, is smaller than the diameter of the bore of the barrel. The direction of movement of the missile is established by the path of the carrier as it passes along the barrel. After the missile pulls free of the carrier it has no need for contact with the barrel, and such contact is not desirable since it would impart erratic motions to the missile, would tend to slow the flight of the missile, and would create additional noise which might be undesirable in some circumstances. Consequently, in the preferred embodiment of the present invention, the diameter of the missile is appreciably less than the diameter of the barrel, and the missile, after pulling away from the carrier, does not touch the barrel while flying to the target. Thus, in the preferred embodiment of the present invention the missile is not guided in a particular direction by direct contact with the barrel.

The novel features which are believed to characterize the invention, together with further advantages thereof, will be better understood from the following description considered in connection with the accompanying drawings in which the preferred embodiment of the invention is illustrated by way of example.

DESCRIPTION OF THE PREFERRED EMBODIMENT

Figure 1:
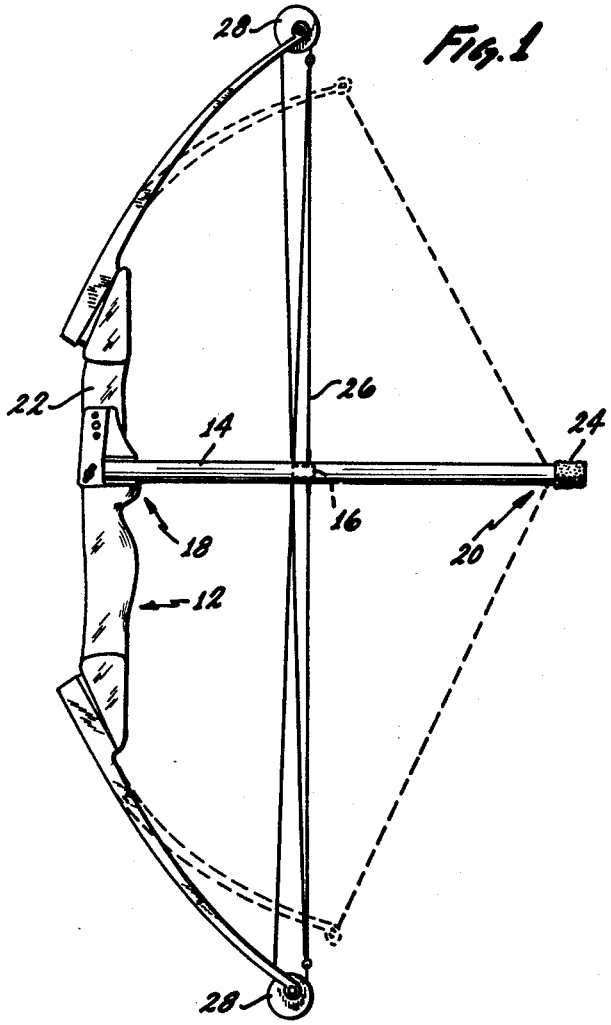
FIG. 1 is a side elevation view of the attachments of the present invention attached to a bow.

Turning now to the drawings, in which like parts are denoted by the same reference numerals throughout the figures, there is shown in FIG. 1 the manner in which the removable attachment of the present invention is related to the archer's bow 12 to which it is affixed. Reduced to its essentials, the attachment of the present invention includes a barrel 14 and a carrier 16, positioned within the barrel 14. The barrel 14 includes a muzzle end denoted generally as 18 and a breech end denoted generally as 20. The barrel 14 is rigidly connected to a central portion 22 of the bow 12 so that the barrel 14 is positioned adjacent the arrow rest over which an arrow would pass if the bow 12 were used in the normal manner. When so affixed, the barrel 14 extends from the central portion 22 of the bow rearward to the breech end 20 which in normal operation is held by the archer. A layer of padding 34 is provided to cover the breech end 20 of the barrel 14 for comfort and safety. The bow illustrated in FIG. 1 includes a bowstring 26 which, as is known in the art, extends over pulleys 28 at the ends of the bow 12, to provide a greater stroke. The drawn positions of the bow and bowstring are shown by dashed lines in FIG. 1.

Figure 2:
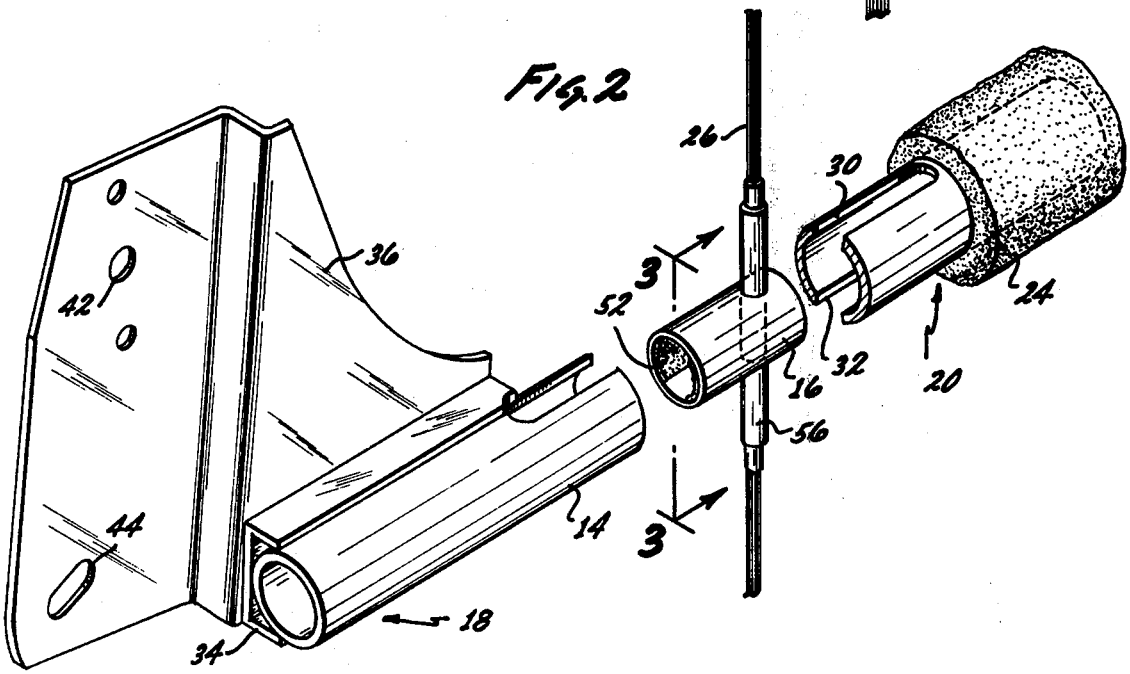
FIG. 2 is an exploded view in perspective showing the interrelationship of the bowstring, the carrier, and the barrel in a preferred embodiment of the present invention.

FIG. 2 more clearly illustrates both the interrelation between the carrier 16 with the barrel as well as the structure used in a preferred embodiment for affixing the muzzle 18 of the barrel to the bow. As shown in FIG. 2, the carrier 16 has the form of a hollow cylinder whose outside diameter is slightly less than the inside diameter of the tubular barrel 14 so that the carrier is freely slidable within the barrel. In the preferred embodiment, the bowstring 26 passes through the carrier 16, so that the carrier is captively associated with the bowstring 26.

Figure 3:
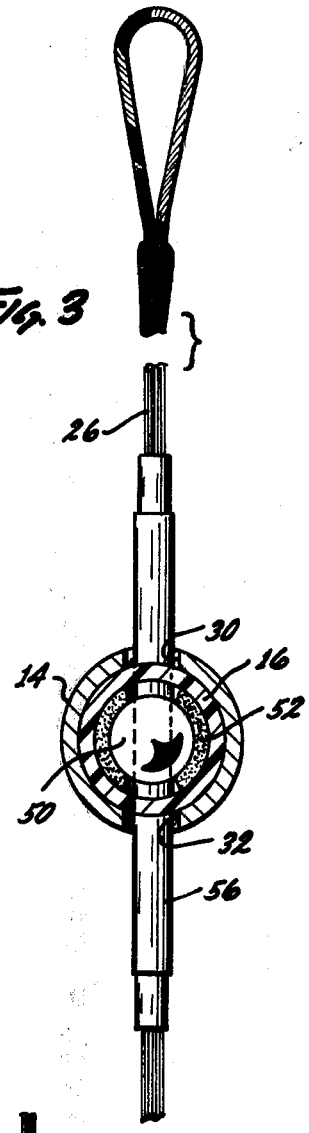
FIG. 3 is a front cross-sectional view looking into the barrel of the present invention from the position indicated by the arrows 3—3 of FIG. 2.

In a preferred embodiment as shown most clearly in FIGS. 2 and 3, a flexible protective tubing 56 of a wear-resistant heat shrinkable plastic tubing is applied around the bowstring 26 where it passes through the barrel and through the carrier, to protect it from fraying.

To accommodate the normal motion of the bowstring 26, the barrel 14 is provided with the elongated slots 30, 32 which extend along the upper end lower surfaces respectively of the barrel 14.

Figure 5:
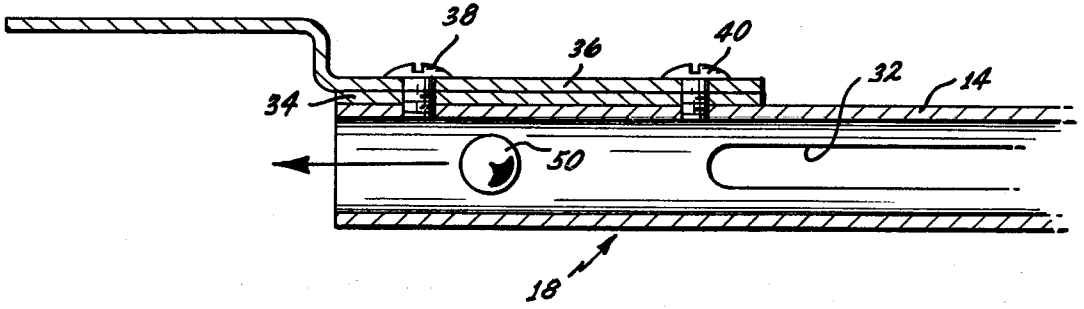
FIG. 5 is a top fractional view in cross-section looking downwardly as indicated by the arrows 5—5 of FIG. 4.

The muzzle end 18, in a preferred embodiment, is cradled in a channel 34 of U-shaped cross-section, and a mounting plate 36 is connected to the channel 34 and the muzzle end 18 by the screws 38, 40 as shown in the top view of FIG. 5.

Figure 4:
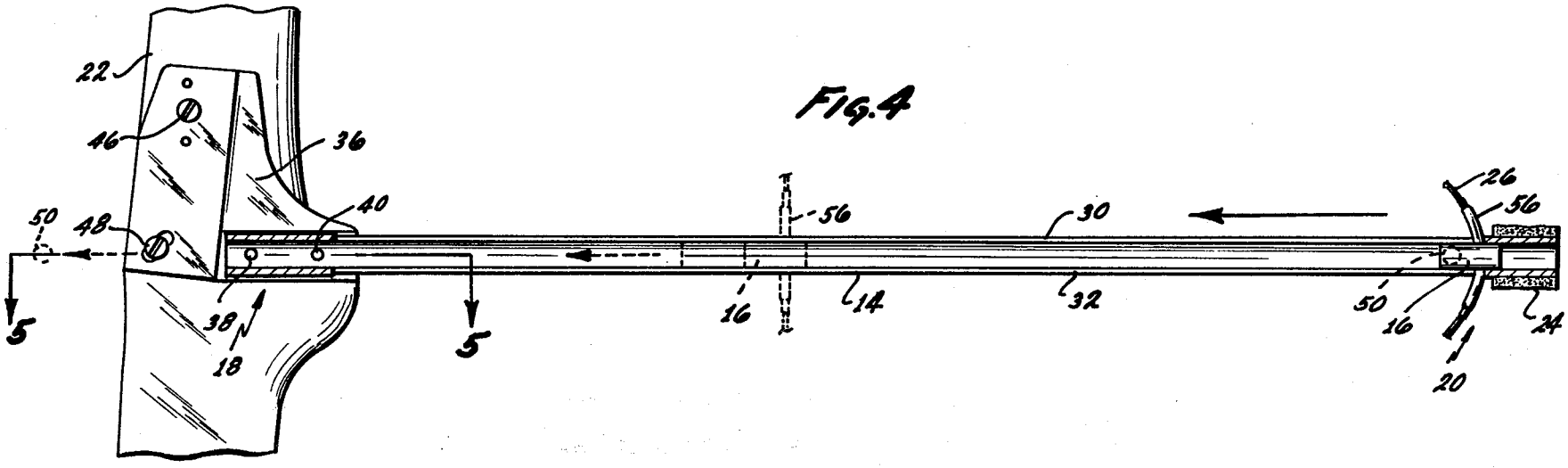
FIG. 4 is a side elevation view in cross-section of a preferred embodiment of the present invention.

The mounting plate includes a first screw hole 42 and a second screw hole 44, the second screw hole 44 being elongated to permit adjustment of the inclination of the barrel with respect to the bow. The attachment is affixed to the central portion 22 of the bow by screws 46, 48 of FIG. 4 which pass through the holes 42, 44.

Figure 6:
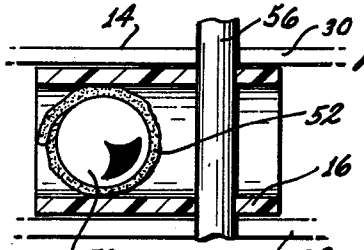
FIG. 6 is a side cross-sectional view showing how the missile is retained by the carrier in a preferred embodiment; and, FIG. 7 is a side cross-sectional view showing how the missile is retained by the carrier in an alternative embodiment of the present invention.

FIG. 3 is a front cross sectional view taken at the point indicated by the arrows 3—3 of FIG. 2. In a preferred embodiment, the missile is a .44 caliber ball 50 held in place within the carrier 16 by a pad 52 of resilient material. In the preferred embodiment, the resilient material is felt. In one embodiment, shown in FIG. 6, a separate patch of felt is wrapped around the ball 50 and jammed into the carrier 16 lodging between the ball and the inside wall of the carrier area. In another embodiment, shown in FIGS. 2 and 3, a pad of felt is attached to the inside wall of the carrier, and the thickness of the felt pad is such that the ball is held in position within the carrier in a tight slidable fit.

Figure 7:
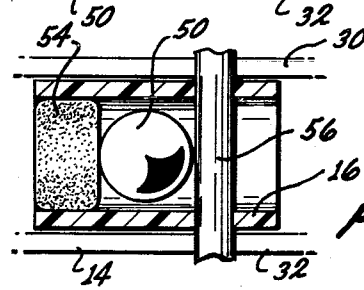

FIG. 7 shows another arrangement for holding the ball 50 in the carrier. In that embodiment, the ball (or balls, i.e., lead shot) 50 is loaded through a muzzle of the barrel and into the carrier 16, and thereafter, a plug 54 of a resilient foamed plastic is tamped into the carrier in front of the ball (or balls, i.e., lead shot) 50. The plug 54 engages the inside wall of the carrier in a tight slidable fit.

Regardless of how the ball 50 is removably held by the carrier 16, it is clear that the diameter of the ball 50 must be smaller than the diameter of the bore of the barrel 14 by an amount at least equal to twice the thickness of the cylindrical wall of the carrier 16. Accordingly, it is not correct to assume that the trajectory of the ball 50 will be stabilized by contact with the inside surface of the barrel 14. On the contrary, in accordance with the preferred embodiment of the present invention, the trajectory of the ball 50 is determined by the direction of the momentum imparted to the ball by the carrier 16, which in turn is derived from contact with the inner surface of the barrel. After the ball 50 has separated from the carrier 16, it continues to move forward through the muzzle end 18 of the barrel without contacting the inner surface of the barrel, as indicated in FIG. 5.

Thus, there has been described a removable attachment which can be rigidly and adjustably affixed to an archer's bow to permit the projection of balls and other projectiles. The projectiles are loaded one at a time through the muzzle of a barrel and inserted into a carrier where they are yieldably held as the carrier is driven by the bowstring along the inside of the barrel.

A preferred embodiment of the invention having been described above, a number of variations of the preferred embodiment will be apparent to those skilled in the art. These other embodiments as well as the preferred embodiment are included within the spirit and scope of the present invention, which is limited only by the claims presented below.

What is claimed is:

1. For use with an archer's bow having a central portion and two ends and including a bowstring passing between the two ends, an attachment permitting projection of a ball or other missile, comprising:

a barrel including a straight hollow tube having a muzzle end and a breach end, and having slots extending longitudinally along opposite sides from a position near said muzzle end to a position near said breech end, the bowstring passing through said slots;

a carrier positioned within said barrel, engaging said barrel in a loose slidable fit so as to be freely slidable longitudinally, said carrier including retaining means for yieldably holding the missile to said carrier so that the missile is retained when said barrel is pointed downwardly and is released toward the muzzle upon deceleration of said carrier, said carrier associated with the bowstring so as to be drawn back toward the breech end with the bowstring when it is drawn and so as to be driven toward the muzzle end by the bow-string when it is released from a drawn position; and, attachment means for rigidly connecting the muzzle end of said barrel to the bow, said attachment means adjustably affixable to the bow to permit the muzzle end of said barrel to be selectively rigidly connected to the bow at various inclinations with respect to the bow.

2. The attachment of claim 1 wherein said retaining means is so shaped that the missile can be brought into holding engagement with it by inserting the missile through the muzzle end of said barrel and moving the missile toward the breech end of said barrel until it engages said carrier.

3. The attachment of claim 2 wherein said carrier is a hollow cylinder open toward the muzzle end of said barrel, and has an inside portion of such size as to receive a portion of the missile.

4. The attachment of claim 3 wherein said retaining means further comprises packing material between the missile and said carrier to produce a tight yieldable fit therebetween.

5. The attachment of claim 3 wherein said retaining means further comprises a plug of wadding material extending across the open end of said cup-shaped carrier so as to yieldably hold the missile in said carrier.

6. The attachment of claim 1 wherein the bow-string is attached to said carrier.

7. The attachment claim 1 wherein the bore of said barrel is sufficiently large relative to the lateral cross section of the missile that, after the missile has separated from said carrier, the missile does not contact said barrel.

* * * * *